United States Patent [19]

Farrer

[11] Patent Number: 4,805,350

[45] Date of Patent: Feb. 21, 1989

[54] KNIFE SHARPENER AND SCABBARD

[75] Inventor: Peter B. Farrer, Victoria, Australia

[73] Assignee: Wiltshire Consolidated Limited, Australia

[21] Appl. No.: 166,815

[22] Filed: Mar. 1, 1988

Related U.S. Application Data

[63] Continuation of Ser. No. 840,474, Mar. 14, 1986, abandoned, which is a continuation of Ser. No. 946,157, Dec. 23, 1986, abandoned, which is a continuation of Ser. No. 750,972, Jun. 28, 1985, abandoned, which is a continuation of Ser. No. 554,723, Nov. 23, 1983, abandoned.

[30] Foreign Application Priority Data

Nov. 24, 1982 [AU] Australia ..... PF6956/82

[51] Int. Cl.[4] ..... B24B 3/54

[52] U.S. Cl. ..... 51/214; 30/138; 76/86

[58] Field of Search ..... 30/138, 151, 164; 51/158, 214; 76/86; 83/174

[56] References Cited

U.S. PATENT DOCUMENTS 3,774,350 11/1973 Bayly ..... 51/214 X 4,041,651 8/1977 Bayly ..... 51/214

4,041,691 5/1978 Bayly ..... 30/138 X

*Primary Examiner*—Douglas D. Watts

*Attorney, Agent, or Firm*—Berman, Aisenberg & Platt

[57] ABSTRACT

A knife scabbard including a hollow housing which is adapted to receive the blade of a knife and which at least partially contains a pivoted carrier member having a blade sharpening device mounted thereon. A latch device is also pivotally connected to the housing and overlies part of the carrier member and in particular that part which carries the sharpening device so as to bear on the upper edge of a knife blade which engages the sharpening device. The pivotal axis of the carrier member is located adjacent a top wall of the housing and at an inner end of the carrier member which is divided so that a knife blade can pass therethrough and intersect the pivot axis. Mounting means for the pivoted inner end of the carrier member comprises a part of the housing and a portion of a spring which also serves to urge the carrier member about the pivot axis towards the housing top wall. The pivot axis of the carrier member is located inwards of the housing relative to the pivot axis of the latch device and a reaction portion of the latch device engages an upper surface of the carrier member at a location between those two axes.

21 Claims, 3 Drawing Sheets

KNIFE SHARPENER AND SCABBARD

This application is a continuation of Ser. No. 840,474, filed Mar. 14, 1986, which is a continuation of Ser. No. 946,157, filed Dec. 23, 1986, now abandoned which is a continuation of Ser. No. 750,972, filed June 28, 1985, which is a continuation of Ser. No. 554,723, filed Nov. 23, 1983 now all abandoned.

This invention relates to a knife sharpener of the kind which is included in a scabbard for receiving and protecting the blade of a knife. Knife sharpeners of the foregoing kind form the subject of U.S. Pat. Nos. 676,961 and 3,774,350 and the present invention is particularly concerned with such prior devices of the kind in which the actual sharpening device is mounted on a movable carrier and the knife blade is inserted into the scabbard between that carrier and a latch member. That kind of arrangement is shown in U.S. Pat. No. 3,774,350.

Sharpeners of the foregoing kind have achieved widespread use, but there are aspects which disturb their efficient operation. One particular problem is that the user is able to hold the knife in such a way that it is lifted from contact with the sharpening device in the course of a sharpening operation, or at least the pressure between the blade and sharpening device is reduced by user influence. That is due in part to the manner in which the carrier is arranged within the scabbard housing. In that regard, the carrier is generally pivotally connected to the housing at a location such that the knife blade passes over the pivotal connection and is able to be pressed against portion of the carrier adjacent that connection so as to lift the blade away from the sharpening device.

A further consequence of the carrier mounting is that the carrier must move through a substantial distance as a knife blade is moved into or out of the scabbard housing. The scabbard housing must have a depth sufficient to permit that movement and that naturally adds to the bulk of the sharpener unit. Also, the resulting absence of close confinement of the knife blade contributes to the possibility of the blade losing contact with the sharpening device as discussed above. Still further, the relatively large movement of the carrier makes it difficult for the sharpening device to produce a substantially consistent cutting angle along the length of the blade cutting edge.

It is an object of the present invention to provide a sharpener unit of the foregoing kind which avoids or minimizes the difficulties discussed above. It is a particular advantage of the present invention that the sharpener mechanism is able to be used in a wide range of scabbard sizes to suit a wide range of knife blades, with equal effectiveness. In particular, that same mechanism can be used, without alteration, to effectively sharpen small blade knives, medium blade knives and deep blade knives. The cost of manufacturing an acceptable range of sharpener scabbards is therefore substantially reduced.

There is another problem which is associated with the foregoing, and that is the need to manufacture different styles of sharpener scabbards to suit different knife blades. Prior to the present invention, three different types of sharpener mechanisms have been used to provide for a standard range of knives. A particular sharpener mechanism has been used for small blade knives (3¼"), the sharpener mechanism according to U.S. Pat. No. 3,774,350 has been used for medium blade knives (6¼") and has been used for deep blade knives.

The need to provide three different types of sharpener mechanisms is inconvenient and adds significantly to manufacturing costs. Prior to the present invention, however, it was thought necessary to have different mechanisms as indicated above in order to provide optimum sharpening over the standard range of knife blades.

According to the present invention, there is provided a knife scabbard including, an elongate housing having a knife receiving passage therein, top and bottom walls of said housing forming upper and lower extremities respectively of said passage, a latch device at a front end of said top wall and forming a forward continuation of that wall, an access opening for said passage at the front end of said latch device, means connecting said latch device to said housing for relative pivotal movement about an axis which extends transverse to said passage and is located adjacent said top wall front end, a carrier member positioned between said latch device and said bottom wall and being at least partially located within said passage and extending lengthwise thereof, a sharpening device mounted on said carrier member at a location adjacent said access opening such that it is engagable by a knife blade extending through said opening, a pivotal mounting for said carrier member having its axis extending transverse to said passage at a location such that it will intersect with a knife blade located in said passage, the pivot axis of said carrier member being located closer to said top wall than said bottom wall and being at an end of said carrier member which is spaced inwardly of said passage from said latch device pivot axis, and biasing means urging said carrier member about the pivot axis thereof to move said sharpening device towards said top wall.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
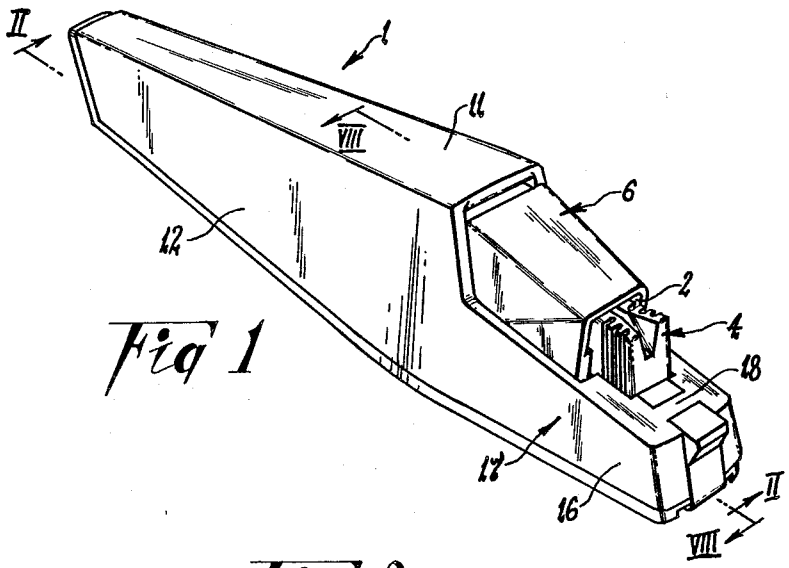
FIG. 1 is a perspective view of one form of knife scabbard to an embodiment of the invention and which is shown without a knife inserted.

The basic concept of the invention can be applied to a wide variety of sharpener constructions, but it will be convenient to hereinafter describe the invention with particular reference to one typical sharpener construction as shown in the accompanying drawings. That example construction includes the usual elongate hollow housing 1 having an access opening 2 at one end and also preforably having means 3 for releasable attachment to a support surface, such as a wall or bench top. The housing 1 at least partially contains a carrier 4 and a biasing spring 5 for the carrier 4, and a latch device 6 is connected to the housing 1 to overlie part of the carrier 4 and to form at least part of the access opening 2. The carrier 4 is arranged to support a sharpening device 39.

It is generally convenient to form the main body of the housing 1 by moulding or otherwise forming a suitable plastics material. In the preferred arrangement shown, the housing 1 is composed of a base part 7 and an upper part 8 which are secured together in any appropriate fashion. The base part 7 as shown includes a bottom wall 9 and a rear end wall 10 of the housing 1, and the upper part 8 includes a top wall 11 and two side walls 12 of the housing 1. A relatively shallow wall portion 13 is provided along each longitudinal side of the bottom wall 9 so as to upstand from that wall 9, and a relatively shallow wall portion 14 is also provided across the front of the bottom wall 9. The front edge 15 of the top wall 11 is stepped back from the front wall portion 14 by a substantial distance and portions 16 of the side walls 12 which extend forwardly of that front edge form part of a strap section 17 which functions as hereinafter described. An interconnecting band 18 extends between the front edges of the two side wall portions 16.

According to the arrangement shown, an upwardly facing locating shoulder 19 is formed on the outside of each wall portion 13 to provide a location for the housing upper part 8. The arrangement is such that each side wall 12 sits neatly over a respective one of the wall portions 13 and has its lower edge resting against the associated shoulder 19. A fastening screw 20 may extend through the lower housing part 7 to engage within the other part 8 in order to hold those parts together, and that screw 20 is preferably located substantially midway between the ends of the housing. In addition, a ledge 21 at the top of the rear wall 10 may snap engage with a catch device 22 provided on the top wall 11 so as to resist separation of the walls 10 and 11, at least in the up or down direction. A similar snap engagement may be provided at the front of the two housing parts 7 and 8 between the wall portion 14 and the front band 18 of the housing upper part 8.

The latch device 6 is pivotally connected to the housing 1 and is arranged so as to be partially exposed in the space above the side wall portions 16. In the arrangement shown, the pivotal mounting for the latch device 6 includes two laterally spaced pedestals 23 which upstand from respective opposite sides of the bottom wall 9, preferably at a location adjacent the front edge 15 of the top wall 11. The pedestals 23 are preferably of a height such as to extend substantially to the top wall. The latch device 6 is arranged to extend between and be pivotally connected to the upper end portion of each pedestal 23 and for that purpose a short axle section 24 provided on each side of the latch device 6 engages within a hole provided in a respective one of the pedestals 23. The axis 25 of that pivotal connection extends transverse to the knife receiving passage 26 provided within the housing 1 and is located between the front and rear ends of the latch device 6.

Figure 2:
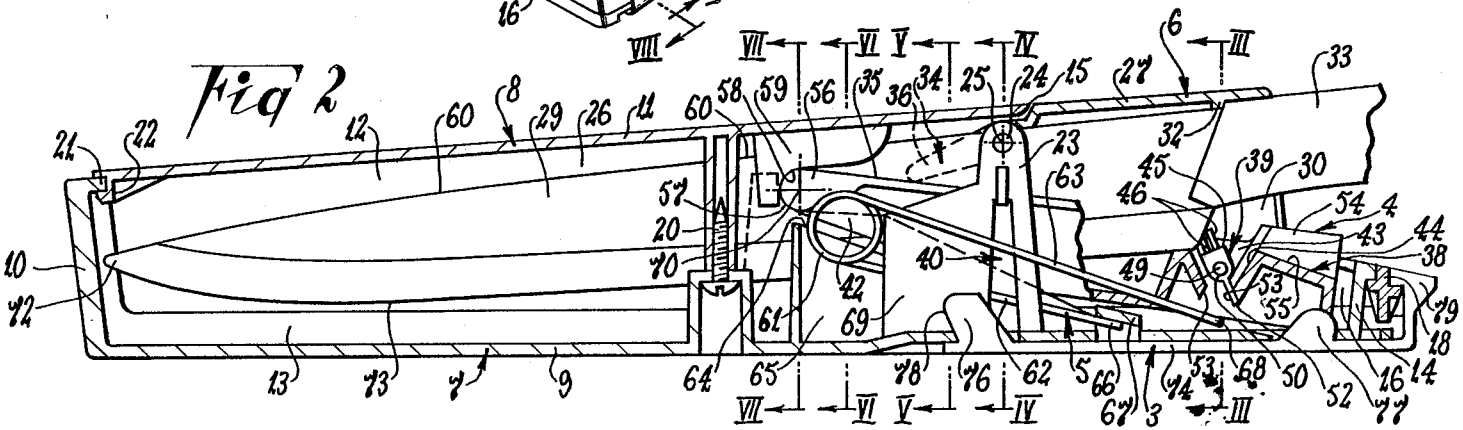
FIG. 2 is a cross sectional view taken along line II—II of FIG. 1 but showing a knife inserted into the scabbard.

The latch device 6 as shown has top and side wall sections 27 and 28, and the top wall section 27 forms a forward continuation of the housing top wall 11 when a knife blade 29 is fully inserted into the housing 1 as shown in FIG. 2. The side wall sections 28 may fit neatly between the housing side walls 12 and preferably retain some degree of overlap with those side walls 12 in the fully inserted position of the knife blade 29. A passage 30 for the knife blade 29 extends longitudinally through the latch device 6 and preferably includes narrow guide groove 31 on the underside of the top wall section 27 and which receives an upper edge portion of the knife blade 29 to provide some lateral support for the blade 29. It is also preferred that the latch device 6 includes stop means 32 which is engagable with the knife handle 33 to prevent inward movement of the knife blade 29 beyond a fully inserted position as shown in FIG. 2.

Figure 3:
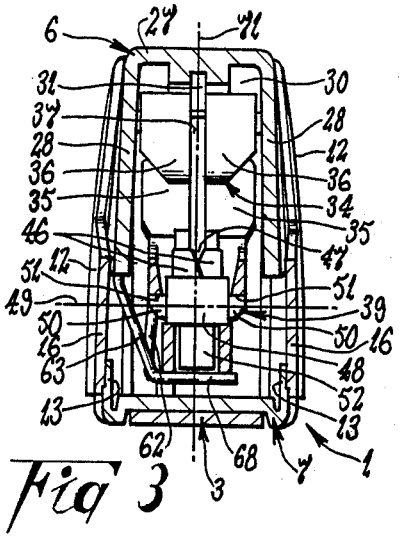
FIG. 3 is a cross sectional view taken along line III—III of FIG. 2 but omitting the knife blade for convenience of illustration.
Figure 4:
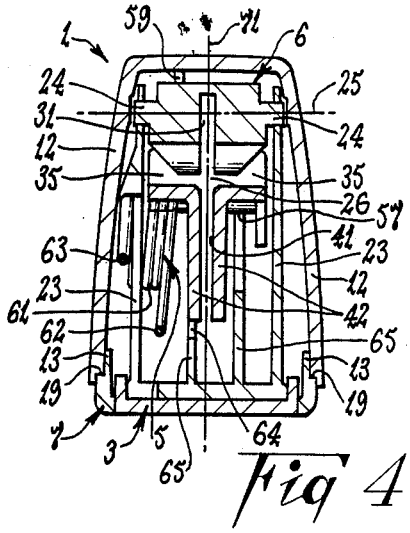
FIG. 4 is a cross sectional view taken along line IV—IV of FIG. 2 but omitting the knife blade for convenience of illustration.
Figure 5:
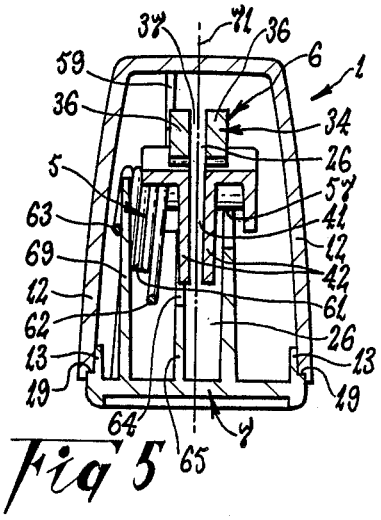
FIG. 5 is a cross sectional view taken along line V—V of FIG. 2 but omitting the knife blade for convenience of illustration.
Figure 8:
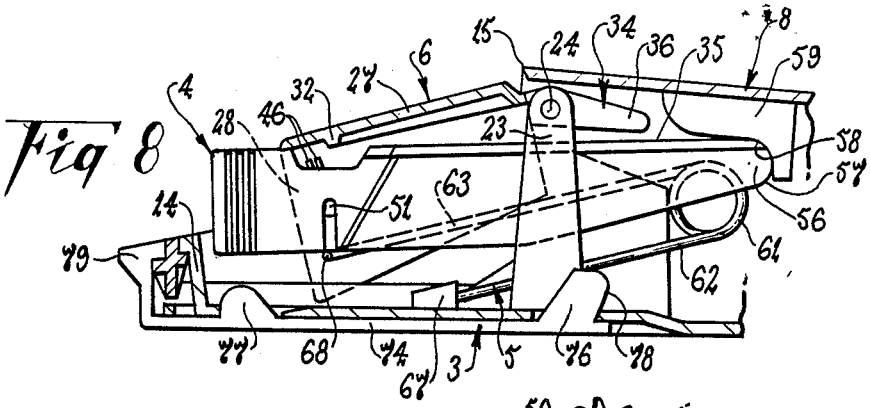
FIG. 8 is a cross sectional view taken along line VIII—VIII of FIG. 1.

The latch device 6 includes a reaction portion 34 which projects rearwardly from the pivot mounting 23, 24 as best seen in FIGS. 3 and 8. The reaction portion 34 engages against an upper surface 35 of the carrier 4 at a location as hereinafter described, and is divided into two laterally spaced parts 36 by a slot 37 which in effect forms a continuation of the guide groove 31. Thus, the two parts 36 are located on respective opposite sides of a knife blade 29 positioned within the housing 1. As shown in FIG. 4, the guide groove 31 preferably extends through the pivotal mounting of the latch device 6 so as to intersect with the pivot axis 25. Such an arrangement is not essential, but does aid in providing a compact assembly.

The carrier 4 is an elongate member having a front section 38 which carries the sharpening device 39 and a rear section 40 which is divided by a longitudinal slot 41 to comprise two laterally spaced arms 42 which extend rearwardly from the front section 38. An upwardly opening cavity 43 is provided in the front section 38 to provide a location for the sharpening device 39 and in the form shown, front and rear sides 44 and 45 respectively of that cavity 43 provide stop surfaces for the sharpening device 39 (FIG. 2).

Figure 9:
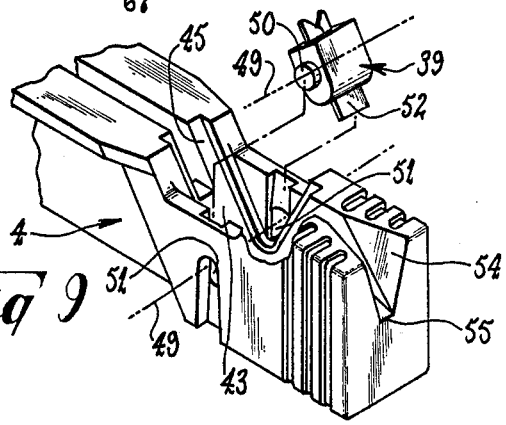
FIG. 9 is a perspective view of the front end part of the carrier member showing the sharpening device removed from that member.

Any suitable sharpening device 39 may be adopted, but in the preferred form shown it comprises a pair of plates 46 of suitable material arranged in overlapped relationship so that a "V" shaped sharpening recess 47 is defined between them. The plates 46 are carried by a mounting block 48 which is located within the cavity 43 and is pivotally connected to the carrier 4 for relative movement about an axis 49 extending transverse to the longitudinal axis of the housing 1. It is preferred, as shown, that the mounting block 48 is snap engaged with the carrier 4 and for that purpose cylindrical axle portions 50 of the block 48 snap engage within suitable openings 51 provided in respective sides of the cavity 43 (see FIGS. 3 and 9). An integral plate spring 52 may extend from the underside of the block 48 for engagement with opposed surfaces 53 (FIG. 2) of the carrier 4 to provide a forward and rearward bias in the extreme rearward and forward positions respectively of the sharpening device 39.

The sharpening device 39 is peferably positioned on the carrier 4 so as to be within the confines of the latch device 6 and adjacent the front end thereof as shown in FIG. 2. A lead recess or groove 54 is provided in the front section 38 of the carrier 4 at a location forwardly of the sharpening device 39 so as to assist in locating a knife blade 29 for engagement with that device 39. That recess or groove 54 is preferably exposed forwardly of the latch device 6 as shown in FIG. 1 and may have a sloping base or ramp surface 55. Furthermore, the sides of the recess or groove 54 may diverge upwardly as shown, at least over a front section located remote from the sharpening device 39.

Pivotal mounting of the carrier 4 is effected at the rear end portion of the carrier arms 42. That rear end portion is separated into two laterally spaced parts 56 by the slot 41 and cooperates with mounting means as hereinafter described. In the form shown, at least one of the end parts 56 includes a cylindrical section 57 which projects laterally from the main body of the associated arm 42 and engages against an arcuate bearing surface 58 which forms part of the aforementioned mounting means. The bearing surface 58 may be formed by a section 59 projecting downwardly from and formed integral with the top wall 11 and is arranged to provide a limit for upward and rearward movement of the rear end portion of the carrier 4. Any suitable means may be provided to releasably retain the cylindrical section 57 in engagement with the bearing surface 58, but the biasing spring 5 preferably serves that function as hereinafter described. The bearing surface 58 is located rearwardly of the latch device pivot 23,24 and is at a height such that in the fully inserted condition of a knife blade 29, the pivot axis 70 of the carrier 4 is intersected by that blade 29. As shown, that axis 70 is located closer to the top wall 11 than the bottom wall 9 thereof, and in the fully inserted position of the blade 29 the axis 70 is preferably close to the upper edge 60 of that blade 29.

Figure 6:
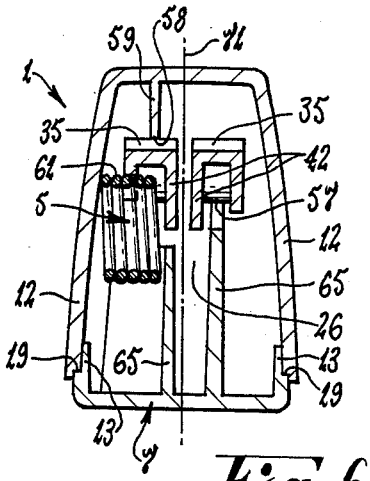
FIG. 6 is a cross sectional view taken along line VI—VI of FIG. 2 but omitting the knife blade for convenience of illustration.

The carrier biasing spring 5 may take any appropriate form, but in the form shown it comprises a helical coil section 61 with two arms 62 and 63 extending laterally from respective opposite ends of that section 61. The two arms 62 and 63 extend generally in the same direction, but in the relaxed condition of the spring 5 they diverge away from the coil section 61 as shown in FIG. 8. In the mounted condition of the spring 5, it is located to extend along one side of the carrier 4 with the coil section 61 engaging against the front side of the cylindrical section 57 which engages the arcuate bearing surface 58. The coil section 61 holds that cylindrical section 57 against the bearing surface 58 and therefore constitutes part of the aforementioned mounting means. The other cylindrical section 57 of the carrier 4 may rest on the upper edge 64 (FIG. 7) of an internal wall portion 65 which upstands from the bottom wall 9. As clearly shown in FIG. 6, the wall portion 65 and spring coil section 61 are located on respective opposite sides of a knife blade located in the housing 1.

The spring arm 62 has its terminal end portion 66 engaged with a suitable retainer 67 on the housing bottom wall 9 and the other arm 63 has its terminal end portion 68 (FIG. 3) engaging beneath the carrier 4, preferably directly beneath the sharpening device 39. The arrangement is such that the spring arms 62 and 63 are tensioned so there is a tendency for their terminal end portions 67 and 68 to move apart. It is preferred as shown that the two arms 62 and 63 extend along respective opposite sides of an internal wall portion 69 which serves to retain those arms 62 and 63 in correct position relative to each other and other parts of the scabbard.

Figure 7:
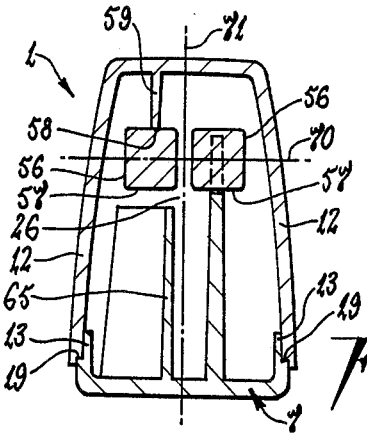
FIG. 7 is a cross sectional view taken along line VII—VII of FIG. 2 but omitting the knife blade for convenience of illustration.

With the foregoing arrangement, the biasing spring 5 pushes the front section 38 of the carrier 4 upwardly to adopt a scabbard unloaded position which is shown in FIGS. 1 and 7. It is preferred that the reaction portion 34 of the latch device 6 engages with the upper surface 35 of the carrier 4 at a location between the carrier and latch pivot axes 70 and 49 so that upward movement of the carrier 4 causes upward movement of the reaction portion 34 of the latch device 6. The arrangement is preferably such that there is not a significant difference between the degree of movement of the latch device 6 and carrier 4 respectively when moving between the loaded and unloaded conditions of the scabbard (FIGS. 1 and 8 respectively).

Figure 10:
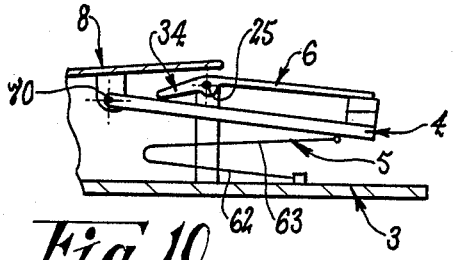
FIG. 10 is a diagrammatic view of the major components of the scabbard showing their relative positions when a knife has not been inserted into the scabbard.
Figure 11:
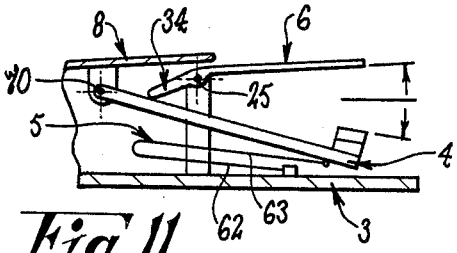
FIG. 11 is a view similar to FIG. 10 but showing the relative positions of the components as adopted when the knife blade is inserted, but omitting the knife blade for convenience of illustration.

In the unloaded condition of the scabbard, the access opening 2 is defined between the latch device 6 and carrier 4 as shown in FIG. 1, but is relatively confined so that when a knife blade 29 is inserted the tip portion 72 of the blade cutting edge 73 (FIG. 2) is urged to engage the sharpening device 39. Penetration of the blade 29 into the scabbard passage 26 causes progressive enlargement of the access opening 2 by forcing the latch device 6 and carrier 4 to move apart at their front ends. Since the biasing spring 5 acts on the carrier 4 substantially directly beneath the sharpening device 39, there is adequate sharpening pressure between that device 39 and the knife blade 29 at the commencement of the blade inward movement. Furthermore, the magnitude of that sharpening pressure remains substantially the same as the knife is moved inwards because of the relatively small degree of movement of the carrier 4 between the unloaded and fully loaded conditions. That small degree of movement also enables a relatively consistent cutting angle to be formed along the cutting edge 73 of the knife blade 29. FIGS. 10 and 11 show in diagrammatic form the relatively small and substantially equal movements of the latch device 6 and carrier 4.

The particular mounting of the carrier 4 also enables the overall height of the scabbard to be kept to a minimum. In addition, the split nature of the rear end portion of the carrier 4 enables that part of the carrier 4 to act as a guide which provides lateral support to a knife blade 29 inserted into the scabbard passage 26. Furthermore, the manner of mounting is such that the carrier 4 can be readily withdrawn from the housing 1. In that regard, it is only necessary to apply a sufficient force to ramp the coil section 61 of the biasing spring 5 downwards to clear the engaging cylindrical section 57 of the carrier 4. Replacement of the carrier 4 can be effected in a similar manner.

Apart from the functional advantages discussed above, a sharpener and scabbard unit as described has the advantage of relative simplicity. The housing 1 for example can be formed of two parts held together by a single screw, and even that screw can be omitted in smaller versions of the unit. The latch device 6 and the carrier 4 can each be formed of a single moulding and each can be snap engaged with the housing 1. Similarly, the sharpening device 39 can be snap engaged with the carrier 4. Manufacture and assembly of the unit is therefore simplified.

Yet another advantage is the almost universal applicability of the various components of the sharpener and scabbard unit. Scabbard housings 1 of different lengths and/or heights will be required to cope with a wide range of knife blade configurations and sizes, but the same carrier 4 and biasing spring 5 can be used in all such housings. The latch device 6 need only be altered in size for deep blade knives.

A further advantage arises out of the particular spring arrangement described in that it produces torsional stress on the carrier 4 thereby enabling the carrier 4 to be made of lighter construction than in prior sharpener units of the same general kind. Furthermore, as stated above, the spring 5 enables substantially constant sharpening pressure to be applied to the knife blade 29 over its entire length thereby promoting consistent sharpening right up to the tip 72 of the blade 29.

Assembly of the sharpener and scabbard unit is also simplified by the fact that the carrier 4, biasing spring 5 and latch device 6 are all assembled on the base part 7 of the housing 1 independant of the housing upper part 8.

Mounting means 3 for the scabbard housing 1 may include a plate-like member 74 which is located within a recess 75 in the underside of the housing bottom wall 9 at a front end portion of that wall 9 (FIGS. 2 and 3). Retaining means on that member 74 cooperates with the housing 1 to resist separation of the housing 1 from the member 74. In the example shown, the retaining means includes two lugs 76 and 77 which project upwardly from the plate-like member 74 and are spaced apart in the longitudinal direction of the housing 1 (FIG. 2). Each lug 76 and 77 is arranged to extend through a respective opening in the housing bottom wall 9 so as to resist relative longitudinal movement of the housing 1. The rearmost lug 76 may have a sloping rear edge 78 so as to overlie part of the bottom wall 9 and a spring detent 79 at the front of the plate-like member 74 may snap engage with the band 18 of the housing upper part 8. With that arrangement, release of the spring detent 79 is required to allow separation of the housing 1 from the plate-like member 34.

It is a feature of the mounting means 3 described that the spring detent 79 is the only part of the means 3 which is visible when the scabbard housing 1 is in position on the mounting means 3. Also, the same mounting means 3 is usable with a wide range of scabbard housing sizes. The plate-like member 34 can be secured to a support in any appropriate manner.

Various alterations, modifications and/or additions may be introduced into the constructions and arrangements of parts previously described without departing from the spirit or ambit of the invention as defined by the appended claims.

Having now described my invention, what I claim as new and desire to secure by Letters Patent is:

1. A knife scabbard including, an elongate housing having a knife receiving passage therein, top and bottom walls of said housing forming upper and lower extremities respectively of said passage, a latch device at a front end of said top wall and forming a forward continuation of that wall, an access opening for said passage at the front end of said latch device, means connecting said latch device to said housing for relative pivotal movement about an axis which extends transverse to said passage and is located adjacent said top wall front end, a carrier member positioned between said latch device and said bottom wall and being at least partially located within said passage and extending lengthwise thereof, said carrier member having a front selection which is adjacent said access opening and a rear section which is remote from that opening, a sharpening device mounted on said front section at a location adjacent said access opening such that it is engageable by a knife blade extending through said opening, a pivotal mounting connecting said carrier member to said housing and having its axis extending transverse to said passage, said pivotal mounting axis being located adjacent said top wall and at an end of said carrier member which is remote from said access opening and is located rearwardly of said latch device pivot axis, biasing means acting between said carrier member and said housing and urging said carrier member about the pivotal mounting axis to move said sharpening device towards said top wall, said latch device reacting with said carrier member at a location between the two said pivot axes so that a front end of said latch device is urged towards said bottom wall, said rear section comprising two laterally spaced arms which extend rearwardly from said front section and define between them an open slot through which a knife blade can pass to project beyond and below said arms, a rear end portion of at least one of said arms forms part of said pivotal mounting, and said rear end portions are arranged so that a knife blade can be received between them and thereby intersect said axis.

2. A knife scabbard according to claim 1 wherein the latch device is of inverted channel form so as to receive therein part of said carrier member at all relative pivotal positions of said latch device and said carrier member.

3. A knife scabbard according to claim 1 wherein said biasing means comprising a spring which acts between said housing and said carrier member, a portion of said spring forms part of said pivotal mounting and is arranged such that said end portion snap engages with said spring portion and is removable therefrom, and a further portion of said spring engages with said carrier member at a location adjacent said sharpening device so as to urge said carrier member about the pivot axis thereof to move said sharpening device toward said top wall.

4. A knife scabbard according to claim 1 which has two laterally spaced arms which extend rearwardly from said front section and define between them an open slot through which a knife blade can pass to project beyond and below said arms.

5. A knife scabbard according to claim 1, wherein said latch device includes a reaction portion which extends into said passage away form the pivot axis of said latch member, and said reaction portion is engagable with an upper surface of said carrier member at a position between the two said pivot axes.

6. A knife scabbard according to claim 5, wherein a guide groove is provided beneath said top wall continuation first slidably receiving an upper edge portion of a knife blade and thereby providing lateral support for said blade.

7. A knife scabbard according to claim 5, wherein said reaction portion is divided into two laterally spaced arts each of which is adapted to be located on a respective side of a knife blade positioned within said passage.

8. A knife scabbard according to claim 6, wherein said guide groove intersects the pivot axis of said latch device.

9. A knife scabbard according to claim 1, wherein said latch device has two laterally spaced side walls which extend forwardly of said top wall front end, and portion of said carrier member which includes said sharpening device is receivable between said side walls.

10. A knife scabbard according to claim 1, wherein said biasing means comprises a spring which acts between said carrier member and said housing, and a portion of said spring forms part of said pivotal mounting and is arranged to releasably retain said carrier member in assembly with said housing.

11. A knife scabbard according to claim 10, wherein said spring portion comprises a coiled portion of the spring which acts against an end portion of said carrier member to resiliently retain that end portion in pivotal engagement with a curved bearing surface which forms part of said pivotal mounting and is an integral part of said housing top wall.

12. A knife scabbard according to claim 11, wherein said end portion includes a cylindrical part which is coaxial with the pivotal axis of said carrier member, and said bearing surface and spring coiled portion engage said cylindrical part on respective opposite sides thereof.

13. A knife scabbard according to claim 11, wherein said bearing surface and said spring coiled portion are located on one side of a median plane of said passage so that they are located beside a broad surface of a knife blade positioned within said passage.

14. A knife scabbard according to claim 10, wherein said spring includes two arms extending generally forwardly of said spring portion, a terminal end portion of one said arm engages with an abutment connected to said bottom wall, a terminal end portion of the other said arm engages said carrier member at a position adjacent said sharpening device, and said spring is biased so that said arms tend to move apart about a fulcrum formed by said spring portion.

15. A knife scabbard according to claim 11, wherein said spring arms extend on respective opposite sides of an internal wall portion of said housing and that wall portion serves to retain the spring arms in correct position relative to each other and to other parts of said scabbard.

16. A knife scabbard according to claim 1, wherein said latch means includes stop means which is engagable with a handle of a knife to limit penetration of said knife into said passage.

17. A knife scabbard according to claim 3, wherein said housing is composed of two parts, one of which includes said bottom wall and the other includes said top wall, a rear end wall is formed integral with said bottom wall, and two laterally spaced side walls are formed integral with said top wall.

18. A knife scabbard according to claim 17, wherein said two housing parts are retained against separation by coaction between top and rear walls, and coaction between a wall portion upstanding from said bottom wall at the front end thereof and a strap section which extends forwardly from each said side wall and across the front of said wall portion.

19. A knife scabbard according to claim 18, wherein further retainer means for said housing parts comprises a screw coacting with both said top and bottom walls at a location between the front and rear ends thereof.

20. A knife scabbard according to claim 3, wherein said connecting means for the latch device includes two pedestals extending upwardly from said bottom wall in laterally spaced relationship so as to receive a knife blade between them, and cylindrical axle portions of said latch device each of which rotatably locates within a hole at an upper end of a respective one of said pedestals.

21. A knife scabbard according to claim 23, wherein the portion of said biasing spring which forms part of said mounting means engages the rear end portion of one of said carrier member arms and resiliently urges that end portion against an arcuate bearing surface formed integral with said top wall, and the rear end portion of the other said carrier member arm is supported by an internal wall portion upstanding from said bottom wall and located so that a knife blade positioned in said passage will have said internal wall portion on one side of said bearing surface on the other side thereof.

* * * * *